United States Patent [19]

Ditterline, Jr. et al.

[11] Patent Number: 4,662,617

[45] Date of Patent: May 5, 1987

[54] SUPPORT BASE FOR SUPPORTING A MOTORCYCLE

[76] Inventors: Andrew F. Ditterline, Jr., 1105 San Antonio Ct., Plano, Tex. 75023; James A. Mann, Jr., 218 Goldfinch Dr., Richardson, both of Tex. 75081

[21] Appl. No.: 755,445

[22] Filed: Jul. 16, 1985

[51] Int. Cl.[4] ..... E05B 73/00

[52] U.S. Cl. ..... 269/16; 269/134; 269/901; 211/17

[58] Field of Search ..... 211/5, 17, 22; 248/500, 248/510, 351; 312/309–313, 357, 240, 108; 269/16, 901, 134; 254/133

[56] References Cited

U.S. PATENT DOCUMENTS

| | | | |
|---|---|---|---|
| 1,696,683 | 12/1928 | Kieffer et al. | 312/313 |
| 2,331,060 | 10/1943 | Turner | 248/500 |
| 3,429,534 | 2/1969 | Bean et al. | 248/500 |
| 4,077,607 | 3/1978 | Lovelady | 211/17 |
| 4,182,454 | 1/1980 | Tohms | 211/5 |
| 4,537,452 | 8/1985 | Rice et al. | 312/282 |

*Primary Examiner*—Robert C. Watson
*Attorney, Agent, or Firm*—Charles D. Gunter, Jr.

[57] ABSTRACT

A support base is shown for supporting a motorcycle where the motorcycle has a footpeg on either side of the motorcycle frame for receiving the rider's foot and where each footpeg is provided with at least one opening therein. The base includes a body having a top support surface for supporting the frame of the motorcycle, a bottom surface and sidewalls therebetween. A tie-down tool is provided which includes a handle and a shank extending outwardly from the handle. The shank is of lesser relative diameter than the handle to allow the shank to pass through the footpeg opening but to restrain the handle. The outer extent of the shank opposite the handle is provided with a hook for engaging a loop on the sidewall of the body to support the motorcycle in upright fashion on the base.

7 Claims, 7 Drawing Figures

81

SUPPORT BASE FOR SUPPORTING A MOTORCYCLE

BACKGROUND OF THE INVENTION

1. Field of the Invention

The present invention relates to devices of the type used in motorcycle maintenance procedures and, specifically, to a support base for supporting a motorcycle during maintenance operations.

2. Description of the Prior Art

Particularly with the so-called "dirt bike," motorcycle, there is a need to perform maintenance and cleaning operations on a regular basis. In order to clean, inspect, or disassembly the various motorcycle components, it is necessary to provide some sort of support for the frame of the motorcycle. In the past, this need generally was met by placing a box or block beneath the motorcycle frame. However, this arrangement did not securely position the motorcycle and it was possible for the motorcycle to topple.

The present invention has as its object the provision of a support base for securely supporting a motorcycle in an upright position during maintenance operations.

Another object of the invention is to provide a base with interior space for storing tools and equipment.

Another object is to provide a base with doors for access to the interior, the doors also serving as trays for tools and equipment during maintenance operations.

Another object of the invention is to provide a unique tie-down tool for use in securing the motorcycle to the base so that the motorcycle will not fall over during maintenance operations.

SUMMARY OF THE INVENTION

The support base of the invention is used to support a motorcycle where the motorcycle has a footpeg on either side of a motorcycle frame for receiving a rider's foot and where each footpeg is provided with at least one opening therein. The support base includes a body having a top support surface for supporting the frame of a motorcycle, a bottom surface and sidewalls therebetween. The body is provided with a tie-down point on each side of two opposite sidewalls of the body.

The tie-down tool used with the base of the invention includes a handle and an adjustable shank extending outwardly from the handle. The shank is of lesser relative diameter than the handle to allow the shank to pass through the footpeg opening but to restrain the handle. The outer extent of the shank opposite the handle is provided with a hook for engaging the tie-down point on the body to support the motorcycle in upright fashion on the base. Each shank end opposite the hook has a theaded exterior surface which is received within a mating bore of the handle so that the length of the shank which extends outwardly from the handle can be adjusted by turning the handle to more securely engage the footpegs.

The body is preferably provided with an opening in at least one of the sidewalls thereof and a door is provided for the sidewall opening. The door preferably has a pair of bars hinged at opposite relative outer extents thereof on an interior surface of the door for swinging movement in a plane generally parallel to the plane of the door. The bars are movable between a retracted position when the door is in place on the opening of the body and an extended position in which the bars are spaced-apart and parallel to one another. The body is provided with a pair of bar openings on at least one of the sidewalls of the body. The bar openings are positioned to slidingly receive the bars when the bars are in the extended position, whereby the doors are supported from the body in planes parallel to the top surface to serve as work trays.

Additional objects, features and advantages will be apparent in the written description which follows.

DETAILED DESCRIPTION OF THE INVENTION

Figure 1:
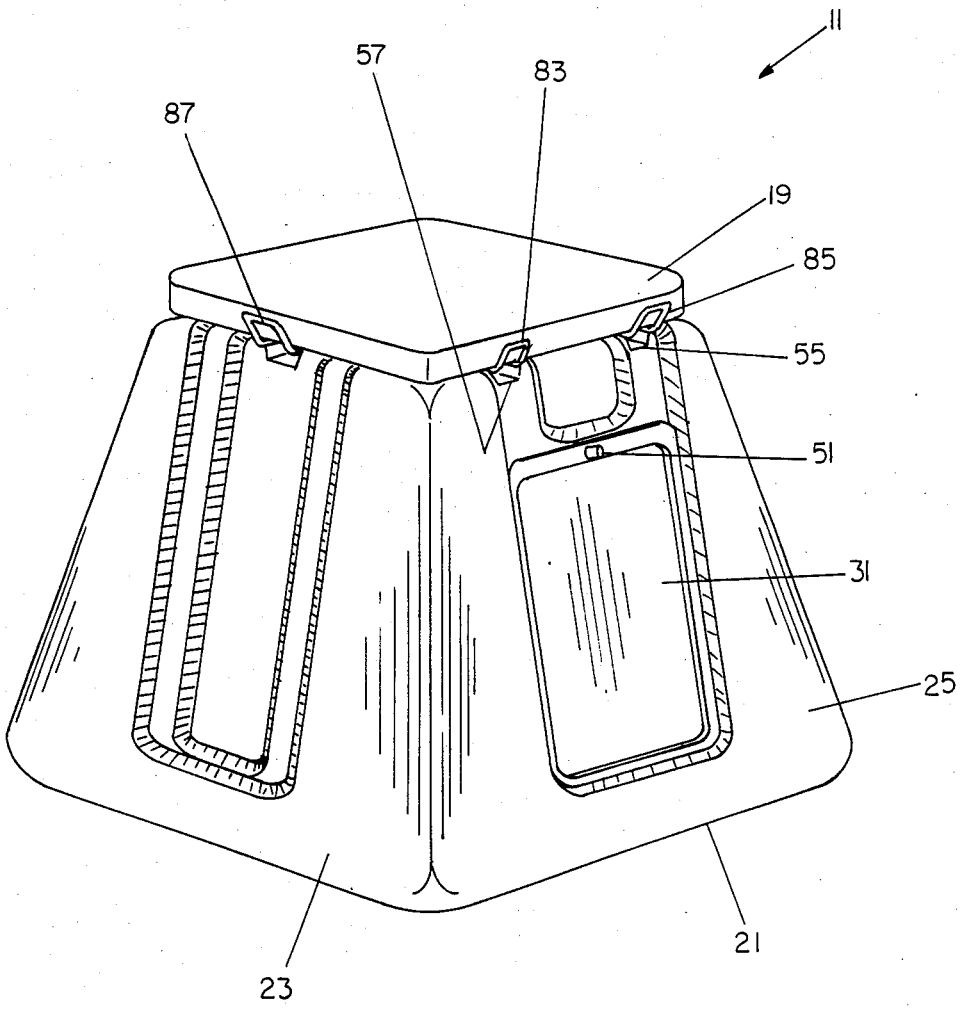
FIG. 1 is a perspective view of the support base of the invention with the doors in place.
Figure 2:
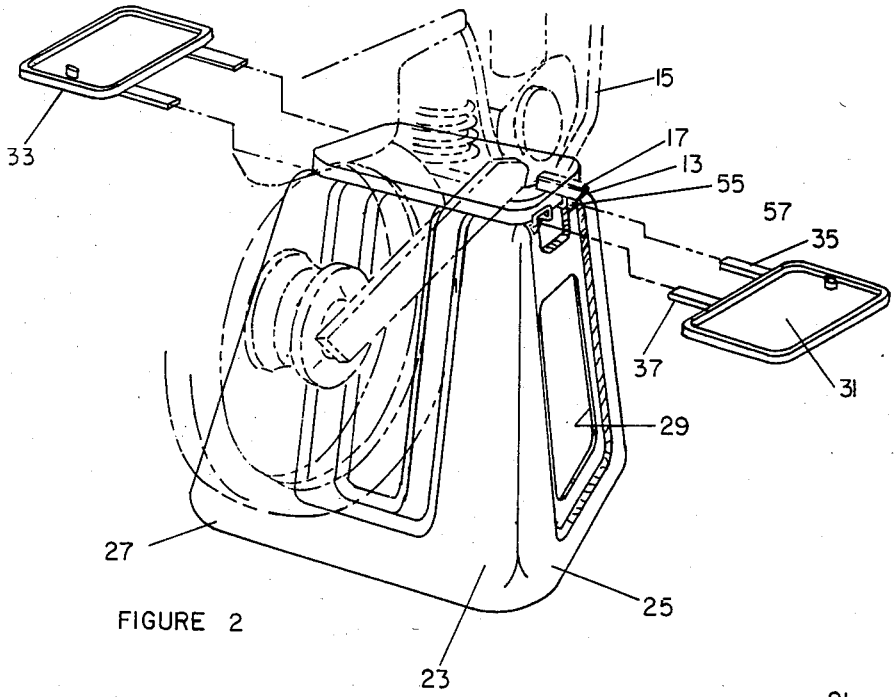
FIG. 2 is a perspective view of the base of FIG. 1 showing the use of the base doors as work trays and showing a portion of a motorcycle frame in phantom lines.

FIG. 1 shows a support base of the invention designated generally as 11. The support base 11 is used to support a motorcycle which has a footpeg 13 (FIG. 2) on either side of a motorcycle frame 15 for receiving a rider's foot and where each footpeg is provided with at least one opening 17 therein. The "footpeg" is a foldable support for the rider's foot and, in the bike shown in FIG. 2 is provided with a central longitudinal slit 17 which traverses the upper and lower planar surfaces of the footpeg 13. Particularly with dirt bikes, the rider often stands upon the footpegs 13 during competitive riding.

The support base 11 (FIG. 1) has a top support surface 19 for supporting the frame of a motorcycle, a bottom surface 21 and sidewalls therebetween. The top support surface 19 can be provided with padding, such as a layer of indoor-outdoor carpet to cushion the motorcycle frame. In the embodiment shown in FIG. 1, the base 11 is provided with four sidewalls (23, 25 shown) which incline inwardarly from the bottom surface 21 toward the top surface 19. At least one of the sidewalls 25 of the body 27 of the support base is provided with an opening 29 into an open interior of the body 27. Preferably, the respective opposite sidewalls of the body 27 are provided with identical openings.

Figure 4:
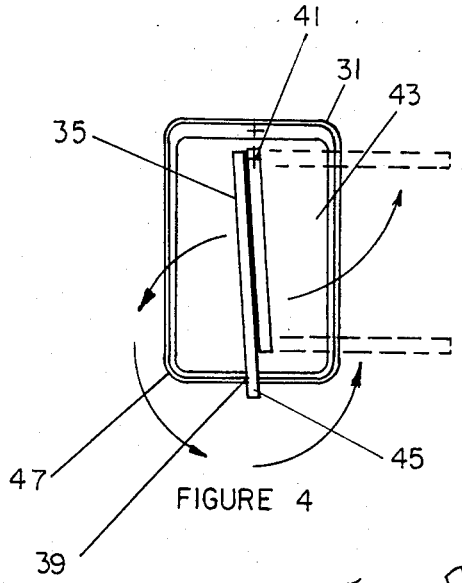
FIG. 4 is a rear view of a door of the base of FIG. 1 showing the hinged movement of the door bars.
Figure 5:
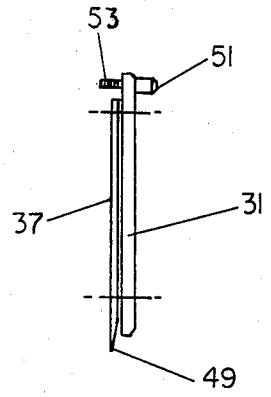
FIG. 5 is a side view of the door of FIG. 4.

Each of the body openings 29 is provided with a door 31, 33. As shown in FIGS. 4 and 5, each door has a pair of bars 35, 37 which are connected at hinge points 39, 41 at opposite relative outer extents thereof on the interior surface 43 of the door 31. The hinge points 39, 41 allow the bars 35, 37 to swing in a plane generally parallel to the plane of the door 31, as indicated in the dotted lines in FIG. 4. The bars are movable between a retracted position shown in solid lines in FIG. 4 when the door is in place on the door opening 29 and an extended position shown in dotted lines in which the bares are spaced-apart and generally parallel to one another.

In the retracted position, a selected one of the bars 37 has an outer extent 45 which extends past the door edge 47 when the bars are in the retracted position. The outer extend 45, as shown in FIG. 5, has a notch region 49 which is received within the door opening 29 to serve as a tab to secure one end of the door 31 within its respective door opening. Each door is also provided with a screwlock 51 having a threaded shaft 53 located at the door extent opposite the bar tab 49 for engaging a mating recess (not shown) provided adjacent the door opening 29 when the bars are in the retracted position.

The body 27 of the base 11 is also provided with a pair of bar openings 55, 57 (FIG. 1) on each of two opposing sidewalls, i.e. 25, of the body 27. The bar openings 55, 57 are selectively positioned to slidingly receive the bars 35, 37 when the bars are in the extended position, whereby the doors 31, 33 are supported from the body in planes parallel to the top surface 19.

Figure 3:
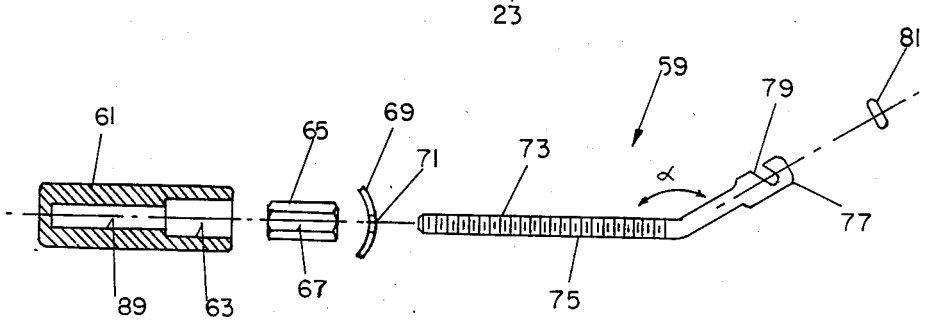
FIG. 3 is an exploded view of a tie-down tool used with the base of FIG. 1.

The support base 11 also includes a tie-down tool, designated generally as 59 in FIG. 3. The tie-down tool includes a handle 61 having an inner recess 63 into which is received a hexagonal-shaped member 65 which has a threaded internal bore 67. A dome-shaped stop 69 has an opening 71 for receiving the threaded exterior surface 73 of an adjustable shank 75. The shank 75 is threadedly received in the bore 67 and extends outwardly from the handle 61 in use. The shank 75 can also be move within the continuation passage 89 of the handle 61 to adjust the length of the shank which extends from the handle.

The shank is of a lesser relative diameter than the handle and stop 69 to allow the shank 75 to pass through the footpeg opening (17 in FIG. 2). A portion of the length of the shank 75 extends outwardly from the handle along the longitudinal axis of the handle 61 and then is bent at an obtuse angle (alpha in FIG. 3) to terminate in a hook 77 having a hook opening 79 for engaging a tie-down point provided on the body 27 of the base 11. A resilient O-ring 81 slips over the shank 75 and is snugly received about the shank to restrain movement of the stop 69 but allows the stop 69 to move in the direction of the hook 77 if the handle 61 is rotated.

Figure 6:
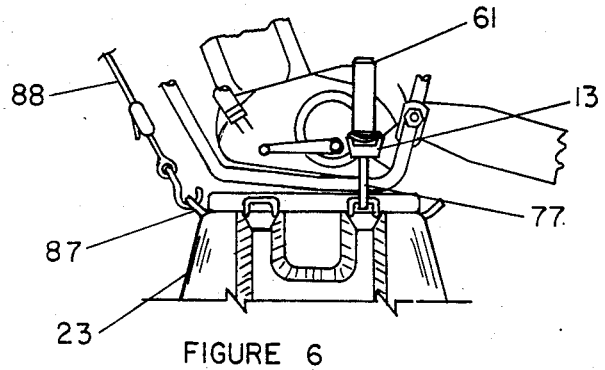
FIG. 6 is a partial, close-up view of the base of FIG. 1 showing a tie-down tool inserted through a footpeg of a motorcycle supported on the base.
Figure 7:
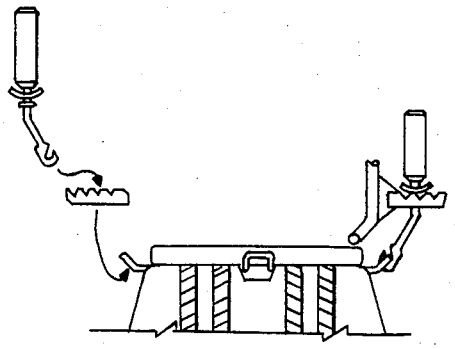
FIG. 7 is a partial, schematic view illustrating the use of the tie-down tool with the base of FIG. 1

As shown in FIGS. 1, 6 and 7, the tie-down points on the base 11 can conveniently comprise metal loops 83, 85 which can be engaged by the shank hook 77 when the shank has been fed through the opening 17 in the motorcycle footpeg 13. An auxiliary tie-down point 87 (FIG. 6) can be provided on adjacent sidewall 23 to receive a tie-down strap 88 which can be cinched to the frame of the motorcycle to add more stability after the tie-down tools have been engaged and tightened.

The operation of the invention will now be described. As shown in FIG. 2, the frame 15 of the motorcycle is first rested upon the top surface 19 with the motorcycle wheels spanning the base body 27. The shank 75 (FIG. 7) of a tie-down tool 59 is then inserted through the opening or slot in the footpeg 13 and the hook 77 is engaged with the metal loop 83 provided on the base 11. The handle 61 of the tie-down tool 59 is then turned which causes the shaft threaded extent 73 to crawl further within the bore 67 and passageway 89 (FIG. 3) of the handle 61. Since the length of the shank 75 is reduced, additional tension results between the stop 69 and metal loop 83 to more securely engage the footpeg 13. Because the bore 67 within member 65 passes through the member and allows the shank 73 to extend partially within passageway 89, the length of the shank 75 which extends outwardly from the handle 61 can be adjusted by turning the handle to more securely engage the footpegs 13.

An invention has been provided with several advantages. The support base of the invention and novel tie-down tools provide a simple and convenient screw-down mounting for supporting a motorcycle upon the base. The screw tightening method utilized allows the support base to be adjusted to fit all brands of motorcycles. The open interior of the base 11 provides a convenient storage area for tools, parts, lubricants, and the like. The doors of the base are conveniently removed and converted to works trays for holding tools during maintenance operations.

While the invention has been shown in only one of its forms, it is not thus limited but is susceptible to various changes and modifications thereof.

I claim:

1. A support base for supporting a motorcycle where the motorcycle has a footpeg on either side of a motorcycle frame for receiving a rider's foot and where each footpeg is provided with at least one opening therein, the support base comprising in combination:

a body having a top support surface for supporting the frame of a motorcycle, a bottom surface and sidewalls therebetween, the body being provided with a tie-down point on each of two opposite sidewalls of the body; and a tie-down tool including a handle and a shank extending outwardly from the handle, the shank being of lesser relative diameter than the handle to allow the shank to pass through the footpeg opening but to restrain the handle, the outer extent of the shank opposite the handle being provided with engagement means for engaging a selected one of the tie-down points on the body to support the motorcycle in upright fashion on the base.

2. The support base of claim 1, wherein the tie-down points provided on the support base are metal loops which extend outwardly from the sidewalls of the base and the engagement means are hooks formed at the shank outer extents having hook openings which are engageable with the metal loops.

3. The support base of claim 2, wherein the shank of each of the tie-down tools extend initially in longitudinal fashion from its respective handle and thereafter bends in dog-leg fashion before terminating in a hook.

4. A support base for supporting a motorcycle where the motorcycle has a footpeg on either side of a motorcycle frame for receiving a rider's foot and where each footpeg is provided with at least one opening therein, the support base comprising in combination:

a body having a top support surface for supporting the frame of a motorcycle, a bottom surface and sidewalls therebetween, the body being provided with a tie-down loop which extends outwardly on each of two opposite sidewalls of the body;

a tie-down including a handle and an adjustable shank extending outwardly from the handle, the shank being of lesser relative diameter than the handle to allow the shank to pass through the footpeg opening but to restrain the handle, the outer extent of the shank opposite the handle being provided with a hook for engaging a selected one of the tie-down loops on the body to support the motorcycle in upright fashion on the base; and wherein each shank end opposite the hook has a threaded exterior surface which is received within a mating bore of the handle so that the length of the shank which extends outwardly from the handle can be adjusted by turning the handle to more securely engage the footpegs.

5. A support base for supporting a motorcycle where the motorcycle has a footpeg on either side of a motorcycle frame for receiving a rider's foot and where each footpeg is provided with at least one opening therein, the support base comprising:

a body having an open interior, a top support surface for supporting the frame of a motorcycle, a bottom surface and sidewalls therebetween, at least one of the sidewalls being provided with an opening into the interior of the body;

a door for the sidewall opening, the door having a pair of bars hinged at opposite relative outer extents thereof on an interior surface of the door swinging movement in a plane generally parallel to the plane of the door, the bars being movable between a retracted position when the door is in place on the door opening of the body and an extended position in which the bars are spaced-apart and parallel to one another; and wherein the body is provided with a pair of bar openings on each of two opposing sidewalls of the body, the bar openings being selectively positioned to slidingly receive the bars when the bars are in the extended position whereby the doors are supported from the body in planes parallel to the top surface.

6. The support base of claim 5, wherein one of the door bars in each of the hinged pairs has an outer extent which extends past the door surface when the bars are in the retracted position, the outer extent of the bar serving as a tab to secure one end of the door within its respective door opening.

7. The support base of claim 6, further comprising a twist lock located at the door extent opposite the bar tab for engaging the opposite door end within the door opening when the bars are in the retracted position.

* * * * *